US010160107B2

(12) United States Patent
Yang et al.

(10) Patent No.: US 10,160,107 B2
(45) Date of Patent: Dec. 25, 2018

(54) FIRING APPARATUS FOR FLOOR NAILING GUN

(71) Applicant: TAIZHOU DAJIANG IND. CO., LTD., Wenling, Zhejiang Province (CN)

(72) Inventors: Ming-Jun Yang, Wenling (CN); Zai-Jun Zhu, Wenling (CN); Song-Song Shao, Wenling (CN)

(73) Assignee: TAIZHOU DAJIANG IND. CO., LTD., Wenling, Zhejiang Province (CN)

( * ) Notice: Subject to any disclaimer, the term of this patent is extended or adjusted under 35 U.S.C. 154(b) by 403 days.

(21) Appl. No.: 14/996,786

(22) Filed: Jan. 15, 2016

(65) Prior Publication Data

US 2016/0221168 A1 Aug. 4, 2016

(30) Foreign Application Priority Data

Feb. 2, 2015 (CN) ..... 2015 1 0053764

(51) Int. Cl.
*B25C 1/04* (2006.01)

(52) U.S. Cl.
CPC ..... *B25C 1/04* (2013.01); *B25C 1/041* (2013.01)

(58) Field of Classification Search
CPC .. B25C 1/00; B25C 1/04; B25C 1/041; B25C 1/042; B25C 1/008
USPC ..... 227/8, 10, 130, 140, 142, 148, 147, 107
See application file for complete search history.

(56) References Cited

U.S. PATENT DOCUMENTS 3,542,273 A * 11/1970 Hedrick ..... B25C 1/041 227/130
3,803,840 A * 4/1974 Toczycki ..... B25C 1/00 227/130
4,907,730 A * 3/1990 Dion ..... B25C 1/008 227/130
6,095,392 A * 8/2000 Batts, Jr. ..... B25C 1/008 227/130
6,155,472 A * 12/2000 Deziel ..... B25C 1/042 227/130
6,834,789 B1 * 12/2004 Dion ..... B25C 1/042 227/130
7,213,735 B1 * 5/2007 Ou ..... B25C 1/042 227/107
7,401,719 B2 * 7/2008 Ou ..... B25C 1/041 227/107
2007/0017954 A1 * 1/2007 Dion ..... B25C 1/00 227/148

(Continued)

*Primary Examiner* — Scott A. Smith
(74) *Attorney, Agent, or Firm* — Locke Lord LLP; Tim Tingkang Xia, Esq.

(57) ABSTRACT

A firing apparatus for a floor nailing gun includes a hollow shell, a driving device and a front end cover. The driving device and the front end cover are respectively disposed at rear and front end portions of the hollow shell. A piston barrel and a tapping seat are disposed inside the shell. The piston barrel has a first end portion and a second end portion that is smaller than the first end portion, where the second end portion of the piston barrel extends from a front end portion of the shell to the inside of the shell and is connected to the driving device, and the first end portion is connected to the tapping seat. The front end cover is provided with a through hole, such that a front end of the tapping seat passes through the through hole to protrude from the front end cover.

8 Claims, 2 Drawing Sheets

(56) References Cited

U.S. PATENT DOCUMENTS

| | | | | |
|---|---|---|---|---|
| 2007/0257081 | A1* | 11/2007 | Dion | B25C 1/008 227/148 |
| 2008/0245840 | A1* | 10/2008 | Beauclair | B25C 1/041 227/148 |
| 2009/0166392 | A1* | 7/2009 | Dion | B25C 1/042 227/130 |

* cited by examiner

FIRING APPARATUS FOR FLOOR NAILING GUN

CROSS-REFERENCE TO RELATED APPLICATION

This application claims the priority to Chinese Patent Application No. 201510053764.1, filed on Feb. 2, 2015, in the State Intellectual Property Office of P.R. China, which is hereby incorporated herein in its entirety by reference.

FIELD OF THE INVENTION

The present invention relates generally to tools, and more particularly, to a firing apparatus for a floor nailing gun.

BACKGROUND OF THE INVENTION

The background description provided herein is for the purpose of generally presenting the context of the present invention. The subject matter discussed in the background of the invention section should not be assumed to be prior art merely as a result of its mention in the background of the invention section. Similarly, a problem mentioned in the background of the invention section or associated with the subject matter of the background of the invention section should not be assumed to have been previously recognized in the prior art.

Currently, in firing systems of most flooring nail guns on the market, two or more components are separately installed from two ends of a shell, and then are connected and sealed. Once a fault occurs, all components need to be disassembled to identity the fault. Accordingly, not only the assembling efficiency is low, but also the stability and the convenience of maintenance are poor.

Therefore, heretofore unaddressed needs exist in the art to address the aforementioned deficiencies and inadequacies.

SUMMARY OF THE INVENTION

One of the objectives of the present invention is to provide a firing apparatus for a floor nailing gun that is easy for assembling and has good stability, high convenience of maintenance, and high reliability.

In one aspect of the invention, a firing apparatus for a floor nailing gun includes a hollow shell, a driving device, and a front end cover. The driving device is disposed at a rear end portion of the hollow shell and the front end cover is disposed at a front end of the hollow shell. A piston barrel and a tapping seat are disposed inside the shell. The piston barrel is provided with a first end portion and a second end portion, where the second end portion of the piston barrel extends from a front end portion of the shell to the inside of the shell and is connected to the driving device, and the first end portion is connected to the tapping seat. The front end cover is provided with a through hole, such that a front end of the tapping seat passes through the through hole to protrude from the front end cover.

In one embodiment, the first end portion of the piston barrel is provided with a sealing member B, the second end portion of the piston barrel is provided with a sealing member A, the piston barrel and an internal wall of the shell form a front sealing structure by means of the sealing member B, the piston barrel and an internal wall of the shell form a rear sealing structure by means of the sealing member A, and the second end portion of the piston barrel is connected to the driving device by means of the sealing member A.

In one embodiment, either the shell or the piston barrel is provided with a groove, and the sealing member A is located in the groove.

In one embodiment, the second end portion of the piston barrel is provided with an air inflow support ring.

In one embodiment, a buffer gasket is disposed between the front end cover and the tapping seat.

In one embodiment, the front end cover is connected to a front end face of the shell in a threaded-connection manner.

In one embodiment, the driving device is a cylinder.

In one embodiment, the front end of the tapping seat is provided with a positioning device.

In one embodiment, the positioning device is a tapping cap.

In another aspect, the invention relates to a floor nailing gun comprising the firing apparatus as disclosed above.

As compared with the conventional firing apparatuses, the present invention has the following beneficial technical effects:

The piston barrel structure in the present invention not only effectively reduces manufacturing costs, but also improves stability and reliability of the product and prolongs a service life of the product.

According to the present invention, locations of buffer and positioning are changed, which reduces manufacturing difficulties and assembling difficulties of the product, facilitates replacement of vulnerable parts in subsequent maintenance of the product, and reduces subsequent maintenance costs and difficulties.

These and other aspects of the present invention will become apparent from the following description of the preferred embodiment taken in conjunction with the following drawings, although variations and modifications therein may be effected without departing from the spirit and scope of the novel concepts of the invention.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment. The drawings do not limit the present invention to the specific embodiments disclosed and described herein. The drawings are not necessarily to scale, emphasis instead being placed upon clearly illustrating the principles of the invention.

DETAILED DESCRIPTION OF THE INVENTION

Figure 1:
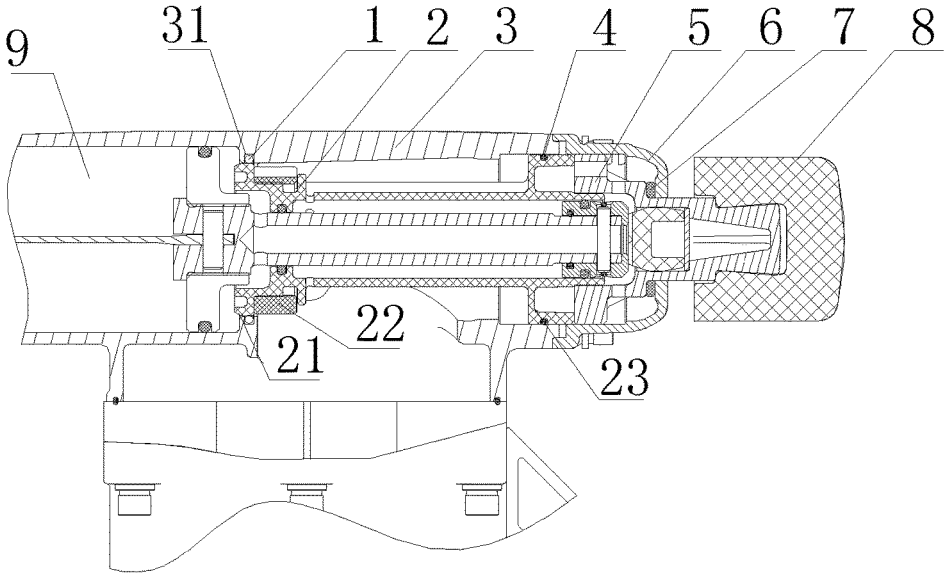
FIG. 1 is a schematic sectional view of a firing apparatus for a floor nailing gun according to one embodiment of the present invention.

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom", "upper" or "top," and "front" or "back" may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The description will be made as to the embodiments of the present invention in conjunction with the accompanying drawings. In accordance with the purposes of this invention, as embodied and broadly described herein, this invention, in one aspect, relates to a firing apparatus for a floor nailing gun.

Figure 2:
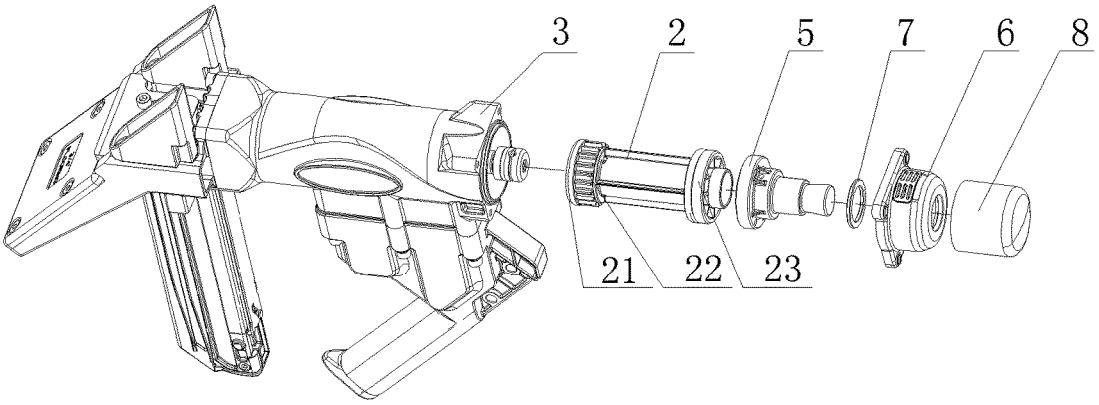
FIG. 2 is a schematic exploded view of a firing apparatus for a floor nailing gun according to one embodiment of the present invention.

Referring to FIGS. 1 and 2, a firing apparatus for a floor nailing gun is shown according to one embodiment of the present invention. In this exemplary embodiment, the firing apparatus includes a hollow shell 3, a driving device 9, and a front end cover 6. The driving device 9 is disposed at a rear end portion of the hollow shell 3, while the front end cover 6 is disposed at a front end of the hollow shell 3. A piston barrel 2 and a tapping seat 5 are disposed inside the shell 3. The piston barrel 2 is provided with a first end portion 23 and an opposite, second end portion 21 that is smaller than the first end portion 23. The second end portion 21 of the piston barrel 2 extends from a front end portion of the shell 3 to the inside of the shell 3 and is connected to the driving device 9, and the first end portion 23 of the piston barrel 2 is connected to the tapping seat 5. The front end cover 6 is provided with a through hole, such that a front end of the tapping seat 5 passes through the through hole to protrude from the front end cover 6.

In certain embodiments, the first end portion 23 is provided with a sealing member B 4, the second end portion 21 of the piston barrel 2 is provided with a sealing member A 1, the piston barrel 2 and an internal wall of the shell 3 form a front sealing structure by means of the sealing member B 4, the piston barrel 2 and an internal wall of the shell 3 form a rear sealing structure by means of the sealing member A1, and the second end portion 21 of the piston barrel is connected to the driving device 9 by means of the sealing member A 1.

In certain embodiments, one of the shell 3 and the piston barrel 2 is provided with a groove 31, where the sealing member A 1 is located in the groove 31.

In certain embodiments, the second end portion 21 of the piston barrel 2 is provided with an air inflow support ring 22.

In certain embodiments, a buffer gasket 7 is disposed between the front end cover 6 and the tapping seat 5.

In certain embodiments, the front end cover 6 is connected to a front end face of the shell 3 in a threaded-connection manner.

In certain embodiments, the driving device 9 is a cylinder.

As a first option, the front end of the tapping seat 5 is provided with a positioning device.

In certain embodiments, the positioning device is a tapping cap 8.

Figure 3:
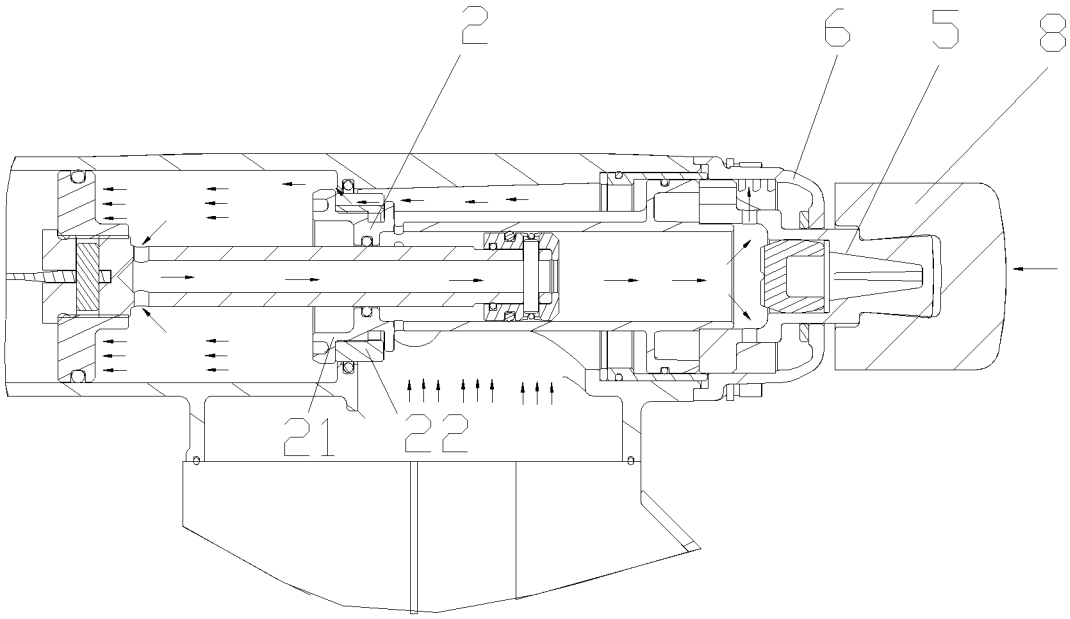
FIG. 3 is a schematic view of a firing apparatus for a floor nailing gun in operation according to one embodiment of the present invention.

As shown in FIG. 3, in operation, the tapping cap 8 is tapped to drive, by means of a structure of the tapping cap 8 and the tapping seat 5, the piston barrel 2 to move backwards, until the tapping cap 8 is positioned on the front end face of the front end cover 6. High-pressure air enters the cylinder (the driving device 9) through the air inflow support ring 22 on the second end portion 21 of the piston barrel to drive the piston to work. When the piston works, some air enters the inside of the piston barrel 2 and the tapping seat 5 through a channel inside the piston and is finally discharged from the front end cover 6.

Figure 4:
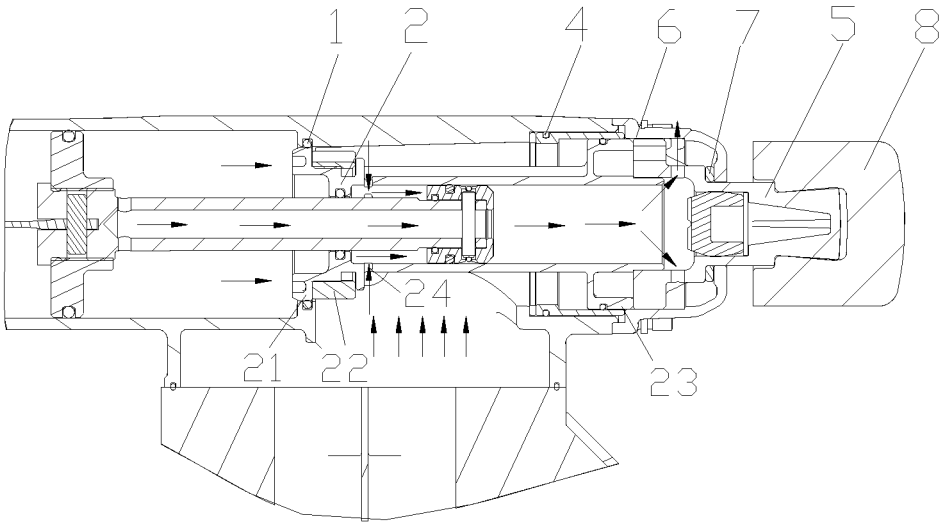
FIG. 4 is a schematic view of a firing apparatus for a floor nailing gun in operation according to another embodiment of the present invention.

As shown in FIG. 4, as external force of tapping the tapping cap 8 disappears, the high-pressure air inside the cylinder (the driving device 9) drives the piston barrel 2 to move forwards, so that the piston barrel 2 is positioned on an internal end face of the front end cover 6 after buffered by the buffer gasket 7. After positioned, the piston barrel 2 is sealed with the shell 3 by means of the sealing members (the sealing member B 4 and the sealing member A1) on the first end portion 23 and the second end portion 21; in this case, the high-pressure air is isolated, that is, the high-pressure air is prevented from entering the cylinder (the driving device 9). The remaining air inside the cylinder is released through a discharge channel. As the piston is driven to work to reduce the pressure of air, some high-pressure air enters the inside of the piston barrel 2 through an air inflow hole 24 of the piston barrel 2 to drive the piston to move forwards to be restored and the piston stops when coming into contact with the tapping seat 5.

In FIGS. 3 and 4, small arrows show air inflows and drive air, and large arrows show an air discharge path.

In addition, the invention also provides a floor nailing gun comprising the firing apparatus as disclosed above.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims, the foregoing description and the exemplary embodiments described therein, and accompanying drawings.

What is claimed is:

1. A firing apparatus usable for a floor nailing gun, comprising:

a hollow shell;

a driving device; and a front end cover, wherein the driving device is disposed at a rear end portion of the hollow shell, and the front end cover is disposed at a front end portion of the hollow shell;

wherein a piston barrel and a tapping seat are disposed inside the shell, the piston barrel has a first end portion and a second end portion that is smaller than the first end portion, the second end portion of the piston barrel extends from a front end portion of the shell to the inside of the shell and is connected to the driving device, and the first end portion is connected to the tapping seat;

wherein the front end cover is provided with a through hole, such that a front end of the tapping seat passes through the through hole to protrude from the front end cover;

wherein the second end portion of the piston barrel is provided with an air inflow support ring; and wherein a buffer gasket is disposed between the front end cover and the tapping seat.

2. The firing apparatus according to claim 1, wherein the first end portion of the piston barrel is provided with a sealing member B, the second end portion of the piston barrel is provided with a sealing member A, the piston barrel and an internal wall of the shell form a front sealing structure by means of the sealing member B, the piston barrel and an internal wall of the shell form a rear sealing structure by means of the sealing member A, and the second end portion of the piston barrel is connected to the driving device by means of the sealing member A.

3. The firing apparatus according to claim 2, wherein one of the shell and the piston barrel is provided with a groove, and the sealing member A is located in the groove.

4. The firing apparatus according to claim 1, wherein the front end cover is connected to a front end face of the shell in a threaded-connection manner.

5. The firing apparatus according to claim 1, wherein the driving device comprises a cylinder.

6. The firing apparatus according to claim 1, wherein the front end of the tapping seat is provided with a positioning device.

7. The firing apparatus according to claim 6, wherein the positioning device is a tapping cap.

8. A floor nailing gun, comprising a firing apparatus usable for a floor nailing gun, wherein the firing apparatus usable for a floor nailing gun comprises:

a hollow shell;

a driving device; and a front end cover, wherein the driving device is disposed at a rear end portion of the hollow shell, and the front end cover is disposed at a front end portion of the hollow shell;

wherein a piston barrel and a tapping seat are disposed inside the shell, the piston barrel has a first end portion and a second end portion that is smaller than the first end portion, the second end portion of the piston barrel extends from a front end portion of the shell to the inside of the shell and is connected to the driving device, and the first end portion is connected to the tapping seat;

wherein the front end cover is provided with a through hole, such that a front end of the tapping seat passes through the through hole to protrude from the front end cover;

wherein the second end portion of the piston barrel is provided with an air inflow support ring; and wherein a buffer gasket is disposed between the front end cover and the tapping seat.

* * * * *